US005833830A

United States Patent [19]

Gonzalez Dominguez et al.

[11] Patent Number: 5,833,830

[45] Date of Patent: Nov. 10, 1998

[54] REDOX CONTROL IN THE ELECTRODEPOSITION OF METALS

[75] Inventors: Jose Alberto Gonzalez Dominguez, Fruitvale; Dilipkumar Devjibhai Makwana, Montrose, both of Canada

[73] Assignee: Cominco Ltd., Vancouver, Canada

[21] Appl. No.: 751,790

[22] Filed: Nov. 18, 1996

Related U.S. Application Data

[63] Continuation of Ser. No. 478,215, Jun. 7, 1995, abandoned.

[51] Int. Cl.[6] ..... C25B 15/02

[52] U.S. Cl. ..... 205/337; 205/335; 205/351; 205/540; 205/793.5; 205/794

[58] Field of Search ..... 205/335, 351, 205/540, 604, 793.5, 794, 607, 337

[56] References Cited

U.S. PATENT DOCUMENTS

| | | | |
|---|---|---|---|
| 2,316,917 | 4/1943 | Wallace . | |
| 3,630,669 | 12/1971 | Naito | 423/101 |
| 4,096,233 | 6/1978 | Bodson . | |
| 4,186,067 | 1/1980 | Blake . | |
| 4,217,189 | 8/1980 | Kerby . | |
| 4,240,826 | 12/1980 | Kangas | 75/109 |
| 4,290,866 | 9/1981 | Bolton | 205/607 |
| 4,439,288 | 3/1984 | Hoffmann | 205/599 |
| 4,693,790 | 9/1987 | Warren . | |
| 4,992,149 | 2/1991 | Nguyen | 205/540 |
| 5,178,771 | 1/1993 | Hayashibe . | |

FOREIGN PATENT DOCUMENTS 550346 12/1957 Canada .

OTHER PUBLICATIONS

Article entitled "Influence of Manganese in Electrodeposition of Zinc" by Stender et al, translated from Zhurnal Prikladnoi Khimii, vol. 33, No. 10, pp. 2238–2245, dated Oct. 1960.

Paper entitled "A View of Zinc Electrowinning Theory" by Geoffrey C. Bratt, Aus. I.M.M. Conf., Tasmania, May 1977, pp. 277–290.

Paper entitled "Fractional Factorial Experiments in the Development of Manganese Dioxide Leaching by Sucrose in Sulphuric Acid Solutions", by F. Veglio and L. Toro, Hydrometallurgy, 36, 1994, pp. 215–230; a reductive leaching process for manganese dioxide using sucrose as the reducing agent is described.

Paper entitled Applications of Hydrogen Peroxide and Peroxysulphuric Acids in Hydrometallurgy, by Burkin et al. No Month/Yr Available.

Paper entitled "Experimental Determination of the Factors Affecting Zinc Electrowinning Efficiency" by A.C. Scott et al, J. Appl. Electrochem, 18, 1988, pp. 120–127; a review of factors that affect current efficiency and energy comsumption. No Month Available.

Paper entitled "The Production of Particulate Manganese Dioxide During Zinc Electrowinning" by Rodrigues and Dry, pp. 199–219. No Month/Yr Available.

Article entitled "New Life for Bottled Blondes", Australian Mining, Nov. 1980.

Paper entitled "Zinc Electrowinning in Acidic Sulphate Electrolytes: Impedance Analysis and Modelling of the Influence of Ni Impurities", by C. Cachet and R. Wiart, J. Electrochem. Soc., vol. 141, No. 1, Jan. 1994, pp. 131–139.

Article entitled "Recovery of Zinc and Manganese from Spent Batteries", by M. Bartolozzi et al, Journal of Power Sources, 48 (1994) 389–392. No Month Available.

*Primary Examiner*—Bruce F. Bell

*Attorney, Agent, or Firm*—Elbie R. de Kock

[57] ABSTRACT

In one embodiment, a method of electrowinning a metal from an electrolyte comprises the steps of measuring the redox potential of the electrolyte to obtain a measured value, comparing the measured value with a predetermined optimum value and adding a redox agent to the electrolyte to adjust the redox potential of the electrolyte to the optimum value. One embodiment of apparatus (10) for carrying out the method comprises a redox potential measuring device (20) having a housing for the flow of electrolyte therethrough and including a pair of electrodes (22, 24) for measuring the redox potential of an electrolyte flowing through the housing to produce an output measurement value and a redox controller (26) responsive to the output measurement value for controlling the addition of redox agent to the electrolyte of an electrolysis cell (12).

23 Claims, 1 Drawing Sheet

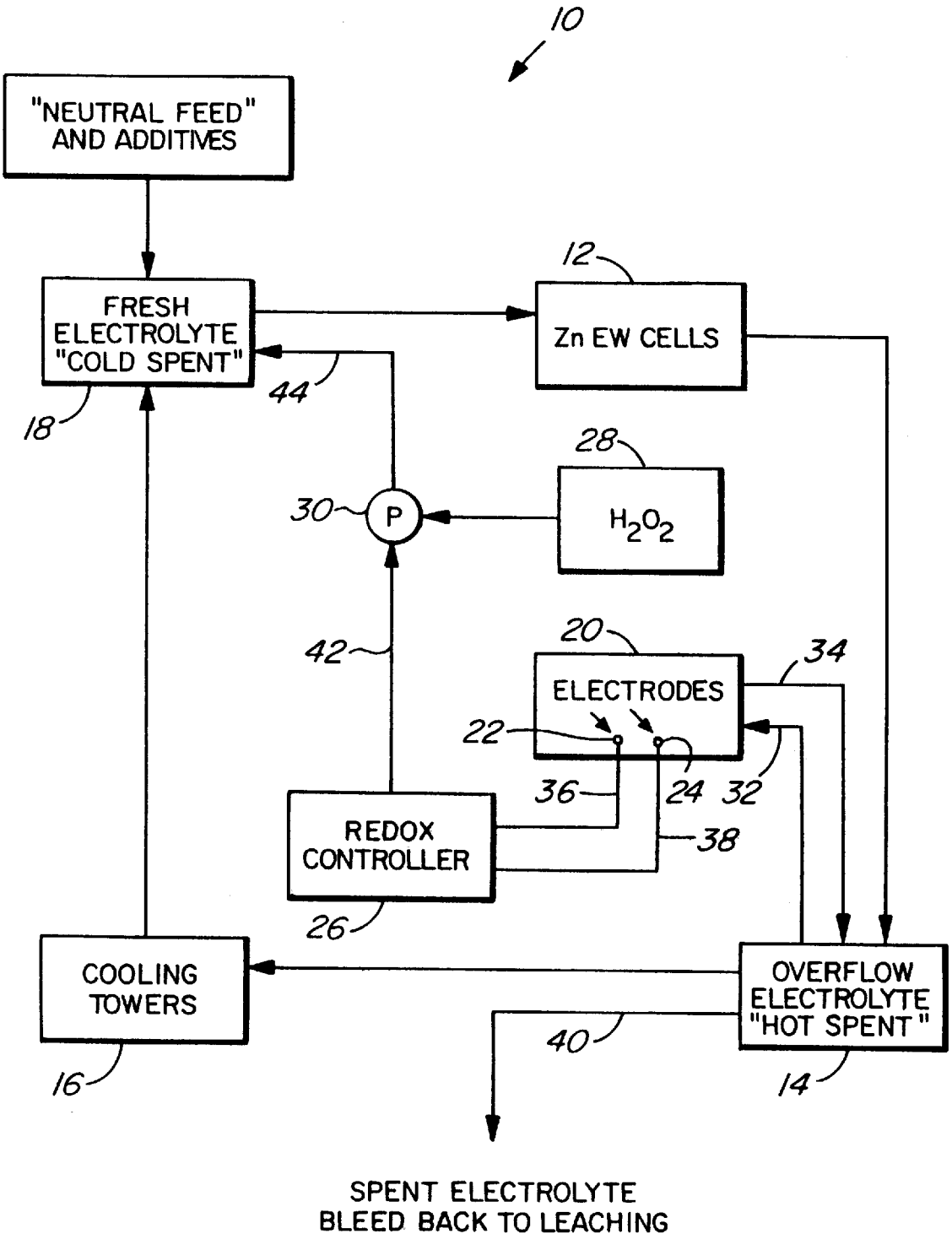
10
"NEUTRAL FEED" AND ADDITIVES
FRESH ELECTROLYTE "COLD SPENT"
18
44
12
Zn EW CELLS
28
30
P
$H_2O_2$
42
20
ELECTRODES
34
22
36
24
32
REDOX CONTROLLER
38
26
COOLING TOWERS
16
OVERFLOW ELECTROLYTE "HOT SPENT"
40
14
SPENT ELECTROLYTE BLEED BACK TO LEACHING

REDOX CONTROL IN THE ELECTRODEPOSITION OF METALS

This application is a continuation of U.S. Pat. application Ser. No. 08/478,215, filed Jun. 7, 1995 now abandoned, the contents of each of the aforementioned applications being incorporated herein by reference.

FIELD OF THE INVENTION

This invention relates to the electrodeposition of a metal from an electrolyte. In particular, but not exclusively, the invention relates to the electrowinning of a metal, such as zinc from zinc sulphate solution, as well as the on line or off line cleaning of an electrolysis cell or an electrode of the cell.

BACKGROUND OF THE INVENTION

In the electrolysis of metals various ionic species can become oxidized or reduced. Thus, unwanted chemical products can be produced. Some of these products precipitate and need to be removed mechanically. Furthermore, such unwanted oxidation-reduction processes can consume electrons that could otherwise be used for the plating of metals, thus, reducing the efficiency of the electrowinning process.

Typically, in the zinc electrowinning industry the Faradaic cathodic current efficiency (CE), i.e. the portion of the current which is actually utilized for the plating of the zinc, ranges from about 88% to about 93%. The difference between this CE value and the 100% value is due to the unwanted evolution of hydrogen and the presence of unwanted redox couples that consume electrons, such as $Fe^{2+}/Fe^{3+}$ and $Mn^{2+}/Mn^{3+}$.

Another factor that affects the CE value is the anode quality and its electrochemical properties. In the electrowinning of zinc, Pb—Ag anodes are normally used. These anodes develop a $PbO_2$ layer upon which $O_2$ evolution and other side reactions can take place. Among the most important of these is the formation of $MnO_2$. $MnO_2$ precipitates on the anode increasing the so-called anodic overpotential and it also precipitates in the cell. This requires frequent anode cleaning which involves the removal of the anodes and the mechanical cleaning thereof. The precipitates that accumulate at the bottom of the cell also need to be removed periodically. These operations often require a plant shutdown, unless expensive mechanized vacuum units are used.

It is an object of the present invention to alleviate the above-mentioned difficulties.

SUMMARY OF THE INVENTION

According to the invention there is provided an electrolysis process wherein an electric current is passed through an electrolyte to effect a chemical change, which includes the step of maintaining the redox potential of the electrolyte within a predetermined range of values by adding a redox agent to the electrolyte.

The process may further comprise the steps of continuously monitoring the redox potential of the electrolyte and adding said redox agent to maintain the redox potential of the electrolyte within said predetermined range of values.

The electrolysis process may comprise an electrowinning process, an electrorefining process or an electroplating process.

Also according to the invention there is provided a method of electrowinning a metal from an electrolyte comprising the step of maintaining the redox potential of the electrolyte within a predetermined range of values by adding a redox agent to the electrolyte.

Further according to the invention there is provided a method of electrowinning a metal from an electrolyte comprising the steps of measuring the redox potential of the electrolyte to obtain a measured value; comparing said measured value with a predetermined optimum value; and adding a redox agent to the electrolyte to adjust the redox potential of the electrolyte to said optimum value.

The term "redox agent" refers to either an oxidizing agent or a reducing agent.

Further according to the invention there is provided apparatus for controlling the redox potential of an electrolyte, comprising a redox potential measuring device for measuring the redox potential of an electrolyte to produce an output measurement value; and a redox controller responsive to said output measurement value for controlling the addition of redox agent to the electrolyte of an electrolysis cell.

Also according to the invention there is provided a method of reducing the formation of an electrolysis product on an electrode of an electrolysis cell comprising the step of performing an electrolysis process in the cell with an electrolyte in which a redox agent is added which counteracts the formation of said product.

Further according to the invention there is provided a method of cleaning an electrolysis cell of an electrolysis product formed in the cell, comprising the step of performing an electrolysis process in the cell with an electrolyte to which a redox agent is added which counteracts the formation of said product.

Further objects and advantages of the invention will become apparent from the description of a preferred embodiment of the invention below.

BRIEF DESCRIPTION OF THE DRAWINGS

The single DRAWING is a flow diagram illustrating an electrowinning and redox control process according to the invention.

DETAILED DESCRIPTION OF PREFERRED EMBODIMENT

With reference to the drawing, a system for carrying out a process for the electrowinning of zinc according to the invention is generally indicated by reference numeral 10.

The system 10 comprises a series of electrolytic cells 12, a reservoir 14 for overflow electrolyte ("hot spent") electrolyte from the cells 12, a series of cooling towers 16 for cooling the hot electrolyte from the reservoir 14 and a reservoir 18 for fresh electrolyte, as well as cold spent electrolyte from the cooling towers 16.

The system 10 further includes a redox potential measuring device 20 provided with a working electrode 22 and a reference electrode 24, a redox controller 26 and a reservoir 28 for $H_2O_2$. The reservoir 28 is connected to the reservoir 18 via a pump 30 which is controlled by the redox controller 26 responsive to redox potential measurements effected by the measuring device 20.

The working electrode 22 is a platinum or a silver electrode. The reference electrode 24 is a commercially available calomel or silver/silver chloride electrode.

The control of the redox potential can be effectively achieved only when the proper sensing electrodes are used.

Platinum is very sensitive to small changes in the redox potential and abrupt changes in value can be observed when this electrode is used. However, with the proper process control design, good redox control (within 50 mV) can be achieved. Graphite electrodes have a slower response than platinum and because of this do not display erratic readings. Thus, when graphite is used, changes in redox potential are not as abrupt as those observed with platinum. Thus, a preferred working electrode has been found to be graphite. In laboratory size electrowinning cells, when a graphite electrode is used, redox control can be achieved to within 20 mV.

The redox controller 26 comprises the required electronic circuitry and software for receiving and interpreting a signal representing the measured value from the measuring device 20 and to control the delivery of the required amounts of $H_2O_2$ to the reservoir responsive to the redox measurements by the measuring device 20.

The measuring device 20 is provided with a flow channel (not shown) for the flow of a feed stream of electrolyte therethrough. The electrodes 22 and 24 are exposed to the electrolyte flowing through the channel for measuring the redox potential of the feed stream. As indicated by the arrows 32 and 34, the electrolyte feed stream is circulated from the reservoir 14 containing the overflow (hot spent) electrolyte, which is essentially equivalent to the electrolyte in the cells 12.

The electrodes 22, 24 are connected through electrical connections 36 and 38 to the electronic circuitry of the redox controller 26.

In carrying out a zinc electrowinning process, the pregnant aqueous zinc solution plus the usual additives, which constitutes the "fresh electrolyte", is fed to the reservoir 18 where it is mixed with cold spent electrolyte from the cooling towers 16.

From the reservoir 18 the electrolyte is transferred to the electrolytic cells 12 where the electrodeposition of zinc takes place.

Spent electrolyte overflow from the cells 12 is received by the reservoir 14, from where the electrolyte is circulated through the redox measuring device 20. There is a bleed of spent electrolyte from the reservoir 14, as indicated by the arrow 40, which in the conventional process for the recovery of zinc from ore or concentrate is recycled back to a leaching stage, where zinc is leached from the ore or concentrate by a suitable leach solution.

A part of the hot spent electrolyte in the reservoir 14 is transferred to the cooling towers 16 for cooling and recycle to the fresh electrolyte reservoir 18.

The redox controller 26 is in electrical contact, as indicated at 42, with the pump 30 for controlling the operation of the pump 30. The pump 30 pumps $H_2O_2$ from the reservoir 28 to the fresh electrolyte reservoir 18, as indicated by the arrow 44. It is desirable that the reducing agent being added be well mixed with the electrolyte prior to its addition to the electrowinning cells 12.

In operation, when the measured value of the redox potential from the measuring device 20 falls outside a predetermined optimum range, the redox controller 26 will activate the pump 30 to inject the required amount of $H_2O_2$ into the tank 18 to bring the measured value within the optimum range. The optimum range will depend on the particular system involved.

In particular, the optimum range is determined by aspects such as anodic and cathodic current density, the age of the anode, the composition and temperature of the electrolyte and the concentration of additives in the electrolyte. The optimum range for each particular system therefore needs to be determined empirically.

Therefore, to implement this technology in the industrial environment, laboratory and plant tests need to be conducted in advance to identify the optimum redox potential values at which the electrowinning process needs to be run. In the preferred practice for one zinc electrowinning operation, the optimum redox value was found to be 1040±50 mV (Pt vs $H_2/H^+$ electrode).

The $H_2O_2$ can be added in diluted or concentrated form, preferably in concentrations higher than 35% so that no significant amounts of water are added to the system.

The reaction between $H_2O_2$ and $MnO_2$ occurs without kinetic limitations according to the following equation:

$$MnO_2+2H^++H_2O_2 \rightarrow Mn^{2+}+2H_2O+O_2$$

In addition, the following reaction can take place upon $H_2O_2$ addition:

$$2Mn^{3+}+H_2O_2 \rightarrow 2Mn^{2+}+2H^+O_2$$

Thus, by using a suitable reducing agent, such as $H_2O_2$ in the present example, unwanted chemical products such as $MnO_2$, $Mn^{3+}$ and $Mn^{7+}$ can be continuously removed. The extent to which these reactions take place is controlled by control of the redox potential of the electrolyte. The invention therefore provides a process for the on line or off line cleaning of the cell and anode which increases plant availability and reduces the need for mechanical anode and cell cleaning. In addition, anode life is increased due to a decreased frequency of short circuits caused by excessive or uneven anode coatings.

Instead of direct measurement of the redox potential an indirect measurement can also be used. For example, in situations where there is a correlation between redox potential and solution color, such as in zinc electrowinning from sulphate media, a calorimeter can be used for controlling redox potential, although direct $E_h$ measurement would be more precise.

In laboratory tests which were carried out the electrolyte cells were run in series under galvanostatic conditions. Electrolyte temperature was controlled at 37°±1° C. Electrolyte was recirculated to rates equivalent to the displacement of 1 to 1.5 cell volumes per hour. The $E_h$ of the electrolyte was measured using calibrated bright Pt—calomel electrode pairs. $E_h$ values reported are referred to the $H_2/H^+$ electrode. The $E_h$ was controlled by adding diluted $H_2O_2$ (≈3%) to the recirculating electrolyte. The $E_h$ electrodes were placed in the cell overflow.

The initial electrolyte was prepared from purified zinc electrolyte and reagent grade sulphuric acid. The concentrations of Zn and $H_2SO_4$ were maintained constant by neutral feed additions and continuous electrolyte removal via the overflow weir. Electrolyte composition ranged between 61 and 64 g/L of Zn and 148 and 155 g/L of $H_2SO_4$. The neutral feed Mn concentration was 2.0 g/L. Glue concentration was 2.5 mg/L.

Two central Pg—Ag anodes and four opposing H1S Aluminum cathodes were used. The end cathodes were masked on their back and edges with epoxy resin. The immersed anode dimensions were 6.5 cm×12 cm. The immersed cathode dimensions were 9.3 cm×10.8 cm (central cathodes) and 8.2 cm 11.5 cm (end cathodes). Electrolyte cell volume was 7.3 L. The cathodic current density was set at 440 A/m$^2$.

Anodic and cathodic overpotentials were measured at preset intervals using a saturated Ag/AgCl reference electrode mounted in a Luggin capillary.

Eight continuous tests (Examples 1 to 8 in Table 1) were conducted using "freshly preconditioned anodes" and three cells connected in series. Each of these tests lasted from 43 to 74 hours. Fresh synthetic electrolyte was only used at the beginning of the test (in Example 1). Subsequent tests used the final electrolyte from the previous test.

While short circuits developed in cell 1 in the first and fourth electrodeposition cycles, no short circuits were detected in cells 2 and 3 in any of the electrodeposition cycles. Deposits obtained with $E_h$ control were polycrystalline and smooth, except in the first cycle in which pitting was observed in all the deposits. In all the experiments, Zn deposits could be stripped just as easily as those obtained without $E_h$ control.

TABLE 1

Summary of Results Obtained in Continuous Experiments 1 to 8

| | | Cell No. 1 No Redox Control | | | Cell No. 2 Eh control at 1040 mV | | | Cell No. 3 Eh control at 1140 mV | | |
|---|---|---|---|---|---|---|---|---|---|---|
| Examples | EW Cycle hours | CE, % | [Pb] in Zn, ppm | [Mn] drop g/L | CE, % | [pb] in Zn, ppm | [Mn] drop, g/L | CE, % | [pb] in Zn ppm | [Mn] drop g/L |
| 1 | 68.9 | 87.3 | 100 | 0.50 | 93.4 | 46 | 0.60 | 87.0 | 39 | 0.25 |
| 2 | 42.8 | 92.0 | 28 | 0.40 | 93.4 | 41 | 0.35 | 92.1 | 26 | 0.25 |
| 3 | 43.3 | 92.5 | 17 | 0.90 | 93.9 | 17 | 0.85 | 90.5 | 18 | 0.60 |
| 4 | 42.9 | 77.7 | 64 | 0.90 | 92.2 | 33 | 0.70 | 89.5 | 30 | 0.55 |
| 5 | 45.4 | 90.3 | 16 | 0.85 | 94.5 | 22 | 0.50 | 89.5 | 6 | 0.50 |
| 6 | 73.5 | 90.0 | 13 | 0.15 | 94.9 | 6 | 0.00 | 89.1 | 5 | 0.00 |
| 7 | 49.7 | 91.8 | 7 | 0.40 | 94.9 | 4 | 0.30 | 92.3 | 6 | 0.30 |
| 8 | 47.6 | 91.2 | 7 | 0.40 | 94.9 | 4 | 0.36 | 92.4 | 6 | 0.36 |
| Average | 51.8 | 89.2 | 31 | 0.56 | 94.1 | 22 | 0.46 | 90.1 | 17 | 0.35 |

Anodes were preconditioned in a KF—$H_2SO_4$ electrolyte (34 g/L F, 19 g/L of $H_2SO_4$) at 40° C. at an ACD of 420 A/m$^2$ for 24 h.

The Eh of these cells was controlled as follows:

Cell 1 No $E_h$ control ("Natural $E_h$ conditions")

Cell 2 $E_h$ controlled at 1040 mV

Cell 3 $E_h$ controlled at 1140 mV (occasionally $E_h$ was controlled at lower values)

The mud deposited in the bottom and walls of the cell and on the cathode edgesticks was manually removed (with $H_2O_2$) after the end of Examples 1 (1st Exchange cycle), 3 (3rd Exchange cycle) and 8 (8th Exchange cycle). This was necessary to perform a mass balance on Mn and Pb deportment.

As an indication of the precipitation of insoluble Mn precipitates, the difference in soluble manganese concentration and the average [Mn] in the electrolyte was used:

$$[Mn]_{drop} = [Mn]_{neutral\ feed} - \frac{[Mn]_{initial\ electrolyte} + [Mn]_{final\ electrolyte}}{2}$$

The larger the $[Mn]_{drop}$, the larger the amount of $MnO_2$ that precipitated in each cell.

Changes in CE, lead deportment to cathode Zn, and $[Mn]_{drop}$ as a function of electrolysis time are shown in Table 1. The continuous run lasted 414 h. $E_h$ control was possible within 50 mV of the set point although excursions as high as 200 mV away from it were often observed. This is attributed to the use of Pt sensing electrodes which are very sensitive to small variations in the concentration of redox species in the electrolyte.

The highest CE values were obtained when the $E_h$ was controlled at about 1040 mV (cell 2). On an average, the CE obtained in cell 2 was 94.1% whereas the CE in cell 1 (a cell without $E_h$ control) averaged only 89.2%. Average CE in cell 3 was 90.1%. $E_h$ values in cell 1 were between 1350 and 1500 mV. In the last four EW cycles (Examples 6 to 8) the CE in cell 2 was very high (94.5% to 94.9%) and reproducible.

As shown in Table 1, [Pb] in cathode Zn decreases with electrolysis time. The cells in which the $E_h$ was controlled gave the lowest Pb deportment. On an average, the lowest Pb deportment was obtained in cell 3, followed (in increasing order) by those obtained in cells 2 and 1. It is important to stress that this low Pb deportment was obtained without $SrCO_3$ additions to any of the cells. Usage of $H_2O_2$ did not enhance the corrosion rate of the anodes or the Pb content of the cathodic zinc.

From Mn mass balances it was found that the percentage of Mn losses (e.g., "insoluble" manganese leftover in the cell walls and on the anodes) in cells 2 and 3 (25.9% and 20.6%) was smaller than those obtained in cell 1 (28.4%). Furthermore, the total amount of mud formed in the cells with $E_h$ control (6.1 g in cell 2 and 4.1 g in cell 3) was significantly lower than in the cell without $E_h$ control (9.5 g). As shown in Table 1, the $[Mn]_{drop}$ observed in cells 2 and 3 was lower than in cell 1. This provides further evidence that the $H_2O_2$ treatment is very effective towards $MnO_2$ solubilization. Although lower [Mn] drops were observed in cells 2 and 3 this did not reflect in increases in Pb deportment, suggesting that $H_2O_2$ usage could extend the life of the anodes. As the anodes release less Pb into the cathodic Zn, the $H_2O_2$ consumption decreases, so that at the end of the continuous electrolyte cycle $H_2O_2$ consumption was as low as 1 Kg $H_2O_2$ (100%) per ton of Zn. The tests conducted so far, suggests that, on an average basis, 2 Kg of $H_2O_2$ (100%) per ton of Zn could be required to maximize the CE.

In all the cells cathodic overpotentials were similar (between 0.995 and 1.01 V vs. Ag/AgCl electrode). Anodic overpotential values toward the end of the electrolysis cycle were lower in the experiments performed with $E_h$ control than in those performed without it. This anodic overpotential drop resulted in an equivalent decrease in cell voltage of between 10 to 20 mV. This modest drop in cell voltage could result in 0.3% to 0.6% energy savings.

The results presented in Table 1 give a wide overview of the effects of $E_h$ control in the EW cycle. In the laboratory, anodes are considered "mature" when the [Pb] in cathode Zn is lower than 10 ppm and the [Mn]drop is smaller than 0.4 g/L. This was achieved earlier in the cells with $E_h$ control than in the cells without $E_h$ control. Furthermore, once the anodes in the three cells have "matured" (Examples 7 and 8) the CE in the cells with $E_h$ control was between 0.7% and 3.3% higher than in the cell without $E_h$ control. This provides an insight on the long term effects of the use of redox control. If the anodes are maintained under "top" conditions, the long term effects are that substantial CE improvements could be achieved and maintained.

Redox control of the Zn EW process is a chemical/electrochemical way of improving the operation of the process. This control is primarily aimed at eliminating cell and anode cleaning. Continuous cleaning of anodes can result in significant CE improvements by not allowing short circuits to form and having a stable $PbO_2$—$MnO_2$ layer. Redox control can be achieved using many reducing reagents, such as sucrose and sodium oxalate. Because of the relative low cost and availability of $H_2O_2$, this reagent was chosen. Also the decomposition products generated from the $H_2O_2$ decomposition ($H_2O$ and $O_2$) are compatible with the Zn EW process. Furthermore, the high selectivity of $H_2O_2$ to reduce $Mn^{3+}$ and $MnO_2$ to $Mn^{2+}$ without destroying the $PbO_2$ layer or the aluminum cathodes ($H_2O_2$ can be stored in aluminum containers) made the use of $H_2O_2$ very competitive.

As found in several laboratory experiments, the largest increases in CE with redox control are seen with "new anodes". If $MnO_2$ formation is reduced, short circuits could be prevented causing an increase in anode life and a decrease in the deportment of lead to the cathodic Zn deposit.

The process above has been described with reference to the electrowinning of a metal from an electrolyte, but it is contemplated that the process can also be applied to electrorefining and electroplating operations.

While only preferred embodiments of the invention have been described herein in detail, the invention is not limited thereby and modifications can be made within the scope of the attached claims.

What is claimed is:

1. A method of counteracting or reducing the electrochemical formation of $MnO_2$ precipitate in a process for the electrowinning of a metal from an electrolyte containing metal and manganese ions, which comprises the steps of:

measuring the redox potential of the electrolyte to obtain a measured value;

comparing said measured value with a predetermined optimum value at which the formation of $MnO_2$ is counteracted; and adding a redox agent to the electrolyte to adjust the redox potential of the electrolyte to said optimum value.

2. The method according to claim 1, wherein the metal is zinc and the redox agent is hydrogen peroxide.

3. The method according to claim 1, wherein said measuring of the redox potential of the electrolyte comprises measuring the redox potential of a feed stream of electrolyte substantially equivalent to the electrolyte present in an electrolysis cell in which said electrowinning is carried out.

4. The method according to claim 3, wherein said measuring of the redox potential of said feed stream is carried out continuously and said redox agent is added to maintain said measured value substantially equal to said optimum value.

5. The method according to claim 4, wherein said optimum value falls within a predetermined range and said measured value is maintained at a value within said range.

6. The method according to claim 5, wherein said redox agent is added by mixing said redox agent with the electrolyte prior to the addition of the electrolyte to the electrolysis cell.

7. The method according to claim 6, wherein the redox agent is added to cold spent electrolyte which is recycled from the electrolysis cell.

8. The method according to claim 3, wherein said feed stream comprises spent electrolyte from said electrolysis cell.

9. The method according to claim 3, wherein said feed stream comprises overflow electrolyte from said electrolysis cell.

10. The method according to claim 3, wherein said measuring of the redox potential of said feed stream is carried out using a pair of electrodes located in said feed stream.

11. The method according to claim 10, wherein said pair of electrodes comprises a working electrode and a reference electrode.

12. The method according to claim 11, wherein said working electrode comprises a graphite electrode.

13. The method according to claim 11, wherein said working electrode comprises a platinum electrode.

14. The method according to claim 1, wherein the redox agent comprises a peroxide.

15. The method according to claim 14, wherein the peroxide is hydrogen peroxide.

16. The method according to claim 1, wherein the redox agent is added in a continuous fashion.

17. The method according to claim 16, wherein the redox agent is added in a batchwise fashion.

18. The method according to claim 1, wherein the cell comprises an anode pickling or aging cell.

19. A method for the electrowinning of metal comprising the steps of:

subjecting an electrolyte containing metal and manganese ions to electrolysis in an electrolysis cell with a cathode and an anode, whereby metal is deposited on the cathode and $MnO_2$ precipitate is formed on the anode or in the cell; and counteracting or reducing the said formation of $MnO_2$ by:

measuring the redox potential of the electrolyte to obtain a measured value;

comparing said measured value with a predetermined optimum value; and adding a redox agent to the electrolyte to adjust the redox potential to said optimum value.

20. The method according to claim 19 wherein the metal is zinc and the redox agent is hydrogen peroxide.

21. A method for the electrowinning of metal comprising the steps of:

subjecting an electrolyte containing metal and manganese ions to electrolysis in an electrolysis cell with a cathode and an anode, whereby metal is deposited on the cathode and $MnO_2$ precipitate is formed on the anode or in the cell; and removing the said $MnO_2$ precipitate by:

measuring the redox potential of the electrolyte to obtain a measured value;

comparing said measured value with a predetermined optimum value; and adding a redox agent to the electrolyte to adjust the redox potential to said optimum value.

22. The method according to claim 21, wherein the redox agent comprises a peroxide.

23. The method according to claim 22, wherein the peroxide is hydrogen peroxide.

* * * * *